United States Patent [19]

Ishii

[11] Patent Number: 4,861,660

[45] Date of Patent: Aug. 29, 1989

[54] STRETCHABLE SYNTHETIC POLYMER COMPOSITE FILAMENT

[75] Inventor: Seiji Ishii, Mihara, Japan

[73] Assignee: Teijin Limited, Osaka, Japan

[21] Appl. No.: 2,876

[22] Filed: Jan. 13, 1987

[30] Foreign Application Priority Data

Jan. 20, 1986 [JP] Japan ..... 61-7874

[51] Int. Cl.[4] ..... D02G 3/00

[52] U.S. Cl. ..... 428/371; 428/373; 428/394; 428/395; 428/397; 428/399; 428/400

[58] Field of Search ..... 428/369, 370, 371, 373, 428/374, 377, 397, 399, 392, 394, 395; 57/206, 207, 244, 248, 253

[56] References Cited

U.S. PATENT DOCUMENTS

| | | | |
|---|---|---|---|
| 3,017,686 | 1/1962 | Breen et al. | 57/248 |
| 3,017,740 | 1/1962 | Humphreys | 57/12 |
| 3,038,295 | 3/1962 | Humphreys | 57/225 |
| 3,142,147 | 7/1964 | Betsch | 57/248 |
| 3,940,917 | 3/1976 | Strachaa | 57/207 |
| 4,001,369 | 1/1977 | Shah | 428/397 |
| 4,245,001 | 1/1981 | Phillips et al. | 428/397 |

*Primary Examiner*—Lorraine T. Kendell
*Attorney, Agent, or Firm*—Kenyon & Kenyon

[57] ABSTRACT

A stretchable synthetic polymer composite filament useful for stretchable fabrics, comprises:

(A) an axial filamentary constituent;

(B) a plurality of composite lobe filamentary constituents consisting of protrudent filamentary segments (B1) outwardly protruding from the axial filamentary constituent (A) in different directions from each other and edge filamentary segments (B2) attached to outside ends of the protrudent filamentary segments (B1);

the axial filamentary constituent (A) and the protrudent filamentary segments (B1) consisting essentially of a synthetic thermoplastic elastomer (a), and the edge filamentary segments (B2) consisting essentially of at least one synthetic thermoplastic low elastic polymer (b), in which filament, when not under tension, the composite lobe filamentary constituents (B) are asymmetric with respect to at least one feature of the location thereof, and cross-sectional configurations and sizes of the protrudent and edge filamentary segments (B1 and B2), about the longitudinal axis of the filament, and are spirally coiled around the axial filamentary constituent (A) in alternately reversed two opposite directions.

19 Claims, 5 Drawing Sheets

STRETCHABLE SYNTHETIC POLYMER COMPOSITE FILAMENT

BACKGROUND OF THE INVENTION

1. Field of the Invention

The present invention relates to a stretchable synthetic polymer composite filament. More particularly, the present invention relates to a stretchable synthetic polymer composite filament which has an excellent elasticity and touch but no crimping property, and can be readily handled.

2. Description of the Related Art

Recently, sport wear and stockings are required to have various improved functions, especially a high stretchability.

Two methods are known of imparting a stretchability to artificial filaments. In one such method, the artificial filaments are cubically crimped, and the crimps are imparted to the artificial filaments by a mechanical crimping method, for example, false-twisting, fluid-crimping, or gear crimping, or a thermal crimping method, for example, anisotropic cooling or heating, two different polymer bi-metal structure-crimping or two different polymer eccentric core-in-sheath structure-crimping.

In another such method, stretchable filaments are produced from elastic polymers, for example, natural or synthetic rubber or a synthetic elastomer, for example, polyurethane elastomer. This type of stretchable, filament is disadvantageous in that the rubber or polyurethane elastomer filaments per se exhibit a very poor wearing and knitting processability and a poor dyeing property. Therefore, the disadvantage of the rubber or polyurethane elastomer filaments is avoided by covering the rubber or elastomer filament with another type of filament having a satisfactory processability and dyeing property.

The mechanical and thermal crimping methods are not always satisfactory in view of the functional and physical properties requirements of synthetic filament stockings. Namely, the mechanical crimping methods are disadvantageous in that the thickness and light transmittance of the resultant stretchable fabric are greatly changed when stretched and released, the light transmittance of the fabric is unsatisfactory when released and the stretching stress generated due to the crimps of the filaments is unsatisfactorily low; this low stretching stress results in an unsatisfactory fit and touch of the resultant fabric clothes when worn.

The stretchable filament fabrics produced from the elastomer filaments yarns or composite yarns consisting of elastic filament yarns covered or doubled with another type of yarn having different mechanical and dyeing properties and touch than those of the elastomer filament yarns, exhibit a satisfactory fit and touch when worn. However, in the doubled yarns, the elastomer filament yarns exhibit a poor compatibility with doubling yarns and, therefore, the doubled yarns often generate problems in the knitting process. Also, the doubled yarn knitted fabric exhibits an unsatisfactory light transmittance.

The stretchable fabric made of the covered elastomer filament knitted fabric exhibits a satisfactory fit and touch when worn, and light transmittance, but these covered elastomer filaments are disadvantageous in that the covering process has a low efficiency and thus is very costly.

SUMMARY OF THE INVENTION

An object of the present invention is to provide a stretchable synthetic polymer composite filament which has a satisfactory stretchability and gloss, required for sport clothes and stockings, a good brilliance required for stockings, an easy knitting and wearing processability, a good dyeing property, and a low cost.

The above-mentioned object is attained by the stretchable synthetic polymer composite filament of the present invention, which comprises (A) an axial filamentary constituent extending along the longitudinal axis of the filament;

(B) a plurality of composite lobe filamentary constituents consisting of protrudent filamentary segments (B1) outwardly protruding from the axial filamentary constituent (A) in different directions from each other and extending along the axial filamentary constituent (A) and edge filamentary segments (B2) attached to outside ends of the protrudent filamentary segments (B1) and extending along the protrudent filamentary segments (B1), the axial filamentary constituent (A) and the protrudent filamentary segments (B1) consisting essentially of a synthetic thermoplastic elastomer (a), and the edge filamentary segments (B2) consisting essentially of at least one synthetic thermoplastic low-elastic polymer (b), in which filament not under tension, the composite lobe filamentary constituents (B) are asymmetric with respect to at least one feature of the location thereof, and cross-sectional configurations and sizes of the protrudent and edge filamentary segments (B1 and B2), about the longitudinal axis of the filament, and are spirally coiled around the axial filamentary constituent (A) in alternately reversed two opposite directions.

DESCRIPTION OF THE PREFERRED EMBODIMENTS

Figure 1:
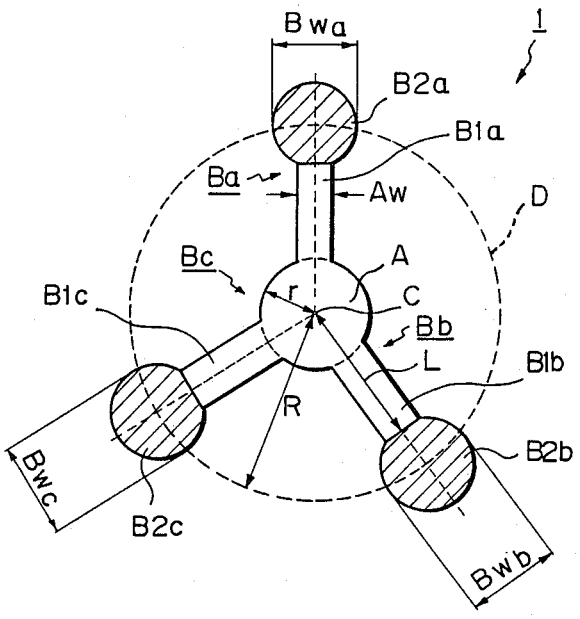
FIG. 1 is a cross-sectional profile of a typical embodiment of the composite filament of the present invention.

The composite filament of the present invention has a specific cross-sectional profile, for example, as indicated in FIG. 1 or any one of FIGS. 2A to 2I.

Referring to FIG. 1, which shows a typical cross-sectional profile of a composite filament of the present invention, a composite filament 1 comprises an axial filamentary constituent A and three composite lobe filamentary constituents Ba, Bb and Bc.

The axial filamentary constituent A is located in a central portion of the composite filament and extended along the longitudinal axis C of the composite filament.

The composite lobe filamentary constituents Ba, Bb and Bc radially protrude from the axial filamentary constituent A in different directions from each other and extend along the axial filamentary constituent A, and thus are in the form of fins.

Each of the composite lobe filamentary constituents Ba, Bb, and Bb consists of a protrudent filamentary segment B1a, B1b, or B1c outwardly protruding from the axial filamentary constituent A in different directions from each other and extending along the axial filamentary constituent A and an edge filamentary segment B2a, B2b, or B2c attached to an outside end of the corresponding protrudent filamentary segment B1a, B1b, or B1c and extending along the protrudent filamentary segment B1a, B1b, or B1c.

In FIG. 1, v refers to a radius of the cross-section of the axial filamentary constituent A, and L refers to a sum of the radium r and a length of the protrudent filamentary segment B1a, B1b or B1c. The ratio L/r is preferably within the range of from 1.1 to 10. When the ratio L/r is less than 1.1, the edge filamentary segments B2a, B2b and B2c sometimes suffer from a small freedom of movement, and a difference in length between the axial filamentary constituent A and the edge filamentary segments B2a to B2c is undesirably small. These features cause the resultant composite filament to exhibit an unsatisfactorily poor stretchability even if the composite lobe filamentary constituents Ba to Bc are spirally wound around the axial filamentary constituent A.

If the ratio L/r is more than 10, sometimes the resultant composite filament is unstable with respect to the cross-sectional profile thereof, which causes difficulty in the production of the composite filament.

When the ratio L/r is in the range of from 3.0 to 10.0, sometimes the resultant composite filament becomes asymmetric with respect to the cross-sectional configuration and size of the composite lobe filamentary constituents around the longitudinal axis of the composite filament, due to strain created in the protrudent filamentary constituent and/or the edge filamentary constituents during the melt spinning procedure, even if a geometrically symmetric composite spinneret is used.

In FIG. 1, the symbol Aw refers to a thickness (width) of the protrudent filamentary segments B1a to B1c, at which thickness the protrudent filamentary segments B1a to B1c are bonded to the corresponding edge filamentary segments B2a to B2c. The smaller the thickness Aw, the higher the freedom of movement of the edge filamentary segments B2a to B2c. However, a small thickness Aw results in a decreased bonding strength between the edge filamentary segments and the protrudent filamentary segments, and in a decreased stability in the processability of the melt-spinning and drawing process. Accordingly, the value of the thickness Aw should be decided after taking the above-mentioned features into consideration.

In FIG. 1, symbols Bwa to Bwc refer to major thickness (widths) which correspond to diameters of the cross-sectional profiles, of the edge filamentary segments B2a to B2c. Also, R refers to a radius of a circle D passing centers (not shown) of the cross-sectional profiles of the edge filamentary segments B2a to B2c, around a center C of the cross-sectional profile of the axial filamentary constituent A.

Preferably, a ratio of $2\pi R$, which is a circumference of the circle D, to the sum $\Sigma BW$ of the thicknesses (widths) BWa, BWb and BWc of the edge filamentary segments B2a, B2b and B2c, is 1.5 or more. When the ratio $2\pi R/\Sigma BW$ is less than 1.5, sometimes in the resultant composite filament not under tension, the edge filamentary segments (B2) come into contact with each other around the axial filamentary constituent (A). This feature restricts the difference between the minimum length of the resultant composite filament not under tension and the maximum length of the filament when under tension and, therefore, causes the resultant composite filament to exhibit an unsatisfactorily decreased stretchability, even if the composite lobe filamentary constituents (B2) are spirally wound around the axial filamentary constituent A.

Although the ratio $2\pi R/\Sigma BW$ has no specific upper limit, preferably the ratio $2\pi R/\Sigma BW$ does not exceed about 15. That is, the ratio $2\pi R/\Sigma BW$ can be designed after taking into consideration the desired stretchability, processability, and handling property of the composite filament.

In the cross-sectional profile of the composite filament of the present invention, the ratio of the sum (area A+B1) of the cross-sectional areas of the axial filamentary constituent A and the protrudent filamentary segments B1 to the sum (area B2) of the cross-sectional areas of the edge filamentary segments B2 is in the range of from 8/2 to 2/8. An increase in the ratio (area A+B1)/(area B2) results in an increase in the stretchability of the resultant composite filament. A decrease in the ratio (area A+B1)/(area B2) results in a decrease in the stretchability and in an increase in the mechanical and dynamic properties of the resultant composite filament.

Accordingly, the ratio (area A+B1)/(area B2) should be designed after taking into consideration the desired stretchability and mechanical and dynamic properties for the composite filament.

Generally, the composite filament of the present invention is provided with two or more composite lobe filamentary constituents (B), each consisting of a protrudent filamentary segment (B1) and an edge filamentary segment (B2) firmly bonded to an outside end of the protrudent filamentary segment (B1).

The composite lobe filamentary constituents (B) are asymmetric with respect to at least one feature selected from the angular location thereof, cross-sectional configurations and sizes of the protrudent and edge filamentary segments (B1 and B2), and type of polymer in the edge filamentary segments B2. The asymmetry with respect to at least one of the above-mentioned features causes the resultant composite lobe filamentary constituents (B) to be spirally coiled around the axial filamentary constituent (A) in alternately reversed two opposite directions, and thus the resultant composite filament exhibits a satisfactory stretchability.

The composite filament of the present invention may have one or more additional lobe filamentary constituent having no edge filamentary segment.

Although the number of the composite lobe filamentary constituents (B) is not limited to a specific upper limit, preferably the upper limit is 6. When the number of the composite lobe filamentary constituents (B) is more than 6, sometimes the ratio $2\pi R/\Sigma BW$ becomes too small and the composite spinneret becomes too complicated, and thus the melt spinning efficiency of the spinneret is decreased. However, when the cross-sectional lengths of the composite lobe filamentary constituent (B) are different from each other, the number of the composite lobe filamentary constituents (B) may be more than 6, for example, 7 or 8.

The edge filamentary segments (B2) are not always required to be completely bonded to the protrudent filamentary segments (B1) along the longitudinal axis of the filament. Nevertheless, where the edge filamentary segments (B2) are substantially continuously bonded to the protrudent filamentary segments (B1), the spiral coiling structure of the resultant composite lobe filamentary constituent (B) and the stretchability of the resultant composite filament become even, and the resultant composite filament can be easily handled and processed.

Where the spirally coiled edge filamentary segments (B2) consist of two or more types of polymers (b) having a different dyeing property from each other, the resultant composite filament can exhibit a very fine different plural color effect not only in the longitudinal direction but also in the transversel direction of the composite filament, and thus overall, a mild color tone.

Figure 2A:
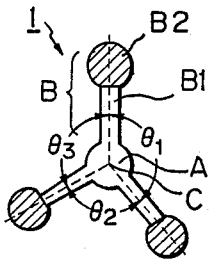
FIGS. 2A to 2I, respectively, are a cross-sectional profile of another embodiment of the composite filament of the present invention.
Figure 2B:
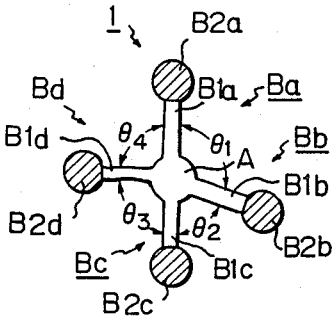
Figure 2C:
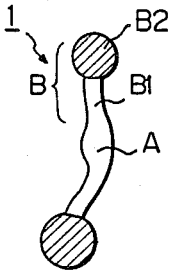
Figure 2D:
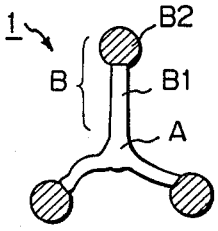
Figure 2E:
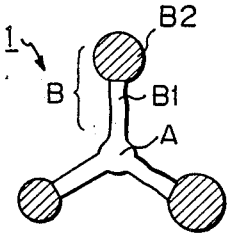
Figure 2F:
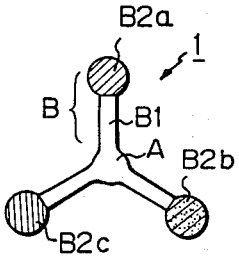
Figure 2G:
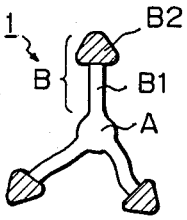

The cross-sectional profiles of the edge filamentary segments B2 are not limited to a specific configuration. Usually, the cross-sectional configuration of the edge filamentary segments B2 is preferably round which causes the resultant composite filament to exhibit a mild gloss and an improved spinning stability. The edge filamentary segments B2 may have an irregular cross-sectional configuration, for example, trilobe as shown in FIG. 2G or oval or flattened oval as shown in FIG. 2I. These irregular cross-sectional configurations are effective for causing the resultant composite filament to exhibit a unique gloss.

Figure 2H:
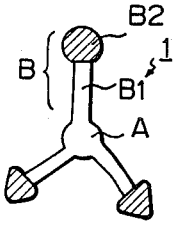
Figure 2I:
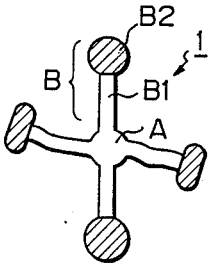

The edge filamentary segments B2 in one composite filament may have different cross-sectional configurations and/or sizes as indicated in FIGS. 2H and 2I. This type of edge filamentary segment B2 is effective for causing the resultant composite filament to exhibit a different plural color and/or gloss effect, not only in the longitudinal direction but also in the transversal direction of the composite filament.

In the composite filament of the present invention not under tension, it is important that the composite lobe filamentary constituents (B) are asymmetric with respect to at least one feature selected from the location thereof and cross-sectional configurations and sizes of the protrudent filamentary segments (B1) and the edge filamentary segments (B2), about the longitudinal axis of the composite filament.

The above-mentioned asymmetrical features cause the composite lobe filamentary constituents (B) to be spirally coiled around the axial filamentary constituent (A) in alternately reversed two different directions as shown in FIGS. 3A to 3D, and thus the resultant composite filament exhibits an improved stretchability and a good touch and gloss.

FIGS. 2A to 2I show examples of the asymmetrical cross-sectional profiles of the composite filaments of the present invention.

Referring to FIG. 2A, a composite filament 1 is composed of an axial filamentary constituent A and three composite lobe filamentary constituents B, which consist of three protrudent filamentary segments B1 and three edge filamentary segments B2. The three composite lobe filamentary constituents B form angles $\theta_1$, $\theta_2$ and $\theta_3$ between each adjacent two thereof. The angles $\theta_1$, $\theta_2$ and $\theta_3$ are different from each other. That is, in the composite filament shown in FIG. 2A, the composite lobe filamentary constituents B are asymmetric in angular location thereof about the longitudinal axis C of the composite filament 1.

Referring to FIG. 2B, a composite filament 1 is composed of an axial filamentary constituent A and four composite lobe filamentary constituents Ba, Bb, Bc and Bd, which form angles $\theta_1$, $\theta_2$, $\theta_3$ and $\theta_4$ between each adjacent two thereof. The angles $\theta_1$, $\theta_2$, $\theta_3$ and $\theta_4$ are different from each other.

The composite lobe filamentary constituent Ba, Bb, Bc and Bd are respectively composed of protrudent filamentary segments B1a, B1b, B1c and B1d and edge filamentary segments B2a, B2b, B2c and B2d.

The cross-sectional lengths, thickness, and cross-sectional area of the protrudent filamentary segments B1a to B1d are different from each other.

Accordingly, the composite lobe constituents Ba to Bd in the composite filament shown in FIG. 2B are asymmetric in location thereof and cross-sectional configuration and size of the protrudent filamentary segments B1a to B1d about the longitudinal axis (not shown) of the filament.

In the composite filament 1 shown in FIG. 2C, two composite lobe filamentary constituents B are asymmetric in the cross-sectional size of the protrudent filamentary segments B1 about the longitudinal axis (not shown) of the filament 1.

In the composite filament 1 shown in FIG. 2D, three composite lobe filamentary constituents B are asymmetric in cross-sectional length, area, and configuration of the protrudent filamentary segments B1 about the longitudinal axis (not shown) of the composite filament 1.

In the composite filament 1 shown in FIG. 2F, the three composite lobe filamentary constituents B are asymmetric with respect to the cross-sectional size of the edge filamentary segments B2 about the longitudinal axis (not shown) of the composite filament 1.

In the composite filament as shown in FIG. 2F, three edge filamentary segments B2a, B2b and B2c respectively consist of thermoplastic low elastic polymers b1, b2 and b3 which are different in type from each other. Therefore, the three composite lobe constituents B are asymmetric with respect to the type of polymer in the edge filamentary segments B2a to B2c, about the longitudinal axis (not shown) of the composite filament 1.

In the composite filament 1 indicated in FIG. 2G, three edge filamentary segments B2 have the same triangular cross-sectional profile as each other, and three protrudent filamentary segments B1 respectively form different angles between each adjacent two thereof from each other and have different cross-sectional configurations from each other.

Therefore, the three composite lobe filamentary constituents B are asymmetric with respect to the angular location thereof and the cross-sectional configuration of the protrudent filamentary segments B1.

In the composite filament 1 indicated in FIG. 2H, the three composite lobe filamentary constituents B are asymmetric with respect to the angular location thereof and cross-sectional configuration and cross-sectional area (size) of the edge filamentary segments B2.

In the composite filament 1 shown in FIG. 2I, four composite lobe filamentary constituents B are asymmetric with respect to the angular location thereof, cross-sectional configuration of the protrudent filamentary segments B1, and cross-sectional size and configuration of the edge filamentary segments B2.

Figure 3A:
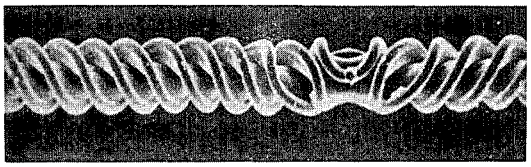
FIG. 3A is a microscopic photograph (×100) of an embodiment of the composite filament of the present invention, not under tension.

Due to the above-mentioned asymmetric features, two or more composite lobe filamentary constituents B are spirally coiled around the axial filamentary constituent A in alternately reversed two opposite directions, not under tension. Referring to FIGS. 3A and 3C, a plurality of composite lobe filamentary constituent B composed of protrudent filamentary segments B1 protruding from an axial filamentary constituent A and edge filamentary segments B2 fixed to the outside ends of the protrudent filamentary segments B1, are in the form of fins and spirally coiled around the axial filamentary constituent A. The turning direction of the composite lobe filamentary constituent B is alternately reversed in a portion T of the filament not under tension.

When stretched, the composite filament can be elongated up to a length approximately similar to the length of the edge filamentary segments B2 while straightening the spirally turned composite lobe filamentary constituents B along the axial filamentary constituent A.

Figure 3B:
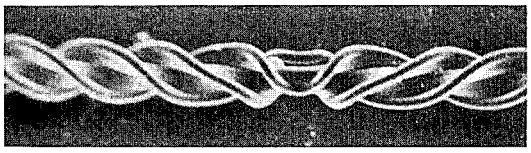
FIG. 3B is a microscopic photograph (×100) of the composite filament shown in FIG. 3A when under tension.
Figure 3C:
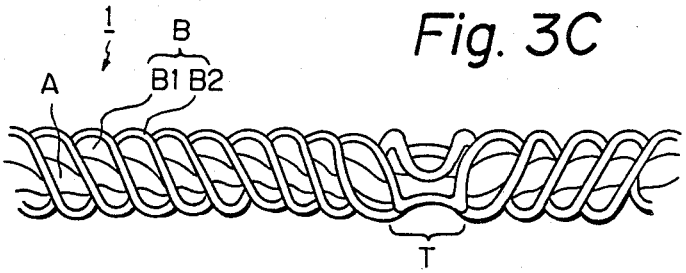
FIG. 3C is a side view of the composite filament shown in FIG. 3A, not under tension.
Figure 3D:
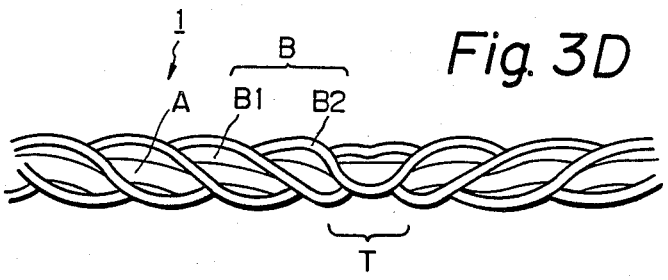
FIG. 3D is a side view of the composite filament shown in FIG. 3B when under tension.

When slightly stretched, the spiral coil structure of the composite lobe filamentary constituents B is deformed as shown in FIGS. 3B and 3D.

In the composite filament of the present invention, the axial filamentary constituent (A) and the protrudent filamentary segments (B1) in the composite lobe filamentary constituents (B) consist essentially of a synthetic thermoplastic elastomer (a).

The elastomer (a) is one capable of forming filaments by a melt-spinning process, and usually has a melting point of from 180° C. to 240° C. and a hardness of 80 to 100 determined in accordance with Japanese Industrial Standard (JIS) K6301-1962. The elastomer (a) is preferably selected from the group consisting of polyurethane, polyamide, and polyester elastomers.

The polyurethane elastomer is preferably selected from thermoplastic polyurethanes which are polymerization products of at least one diol compound selected from polyester prepolymers having two terminal hydroxyl groups and poly(oxyalkylene)glycols with at least one diisocyanate, at least one glycol chain extender and, optionally, at least one polycarbonate having two terminal hydroxyl groups.

The polyester prepolymers preferably include polymerization products of a dicarboxylic acid component consisting of at least one member selected from adipic acid, sebacic acid, and functional derivatives thereof, with a diol component consisting of at least one member selected from ethylene glycol, butylene glycol, and diethylene glycol.

The poly(oxyalkylene)glycols preferably include homopolymers and block copolymers of poly(oxyethylene)glycol, poly(oxypropylene)glycol, and poly(oxybutylene glycol).

The diisocyanates preferably include 2,4-tolulene diisocyanate, diphenylmethane-4,4'-diisocyanate, and dicyclohexylmethane-4,4'-diisocyanate.

The chain extender preferably consists of at least one member selected from ethylene glycol, propylene glycol, butylene glycol, and 1,4-$\beta$-hydroethoxybenzene.

The hydroxyl group-terminated polycarbonate, which is optionally used as a polymerization component, is preferably selected from polymerization products of bisphenol A with phosgene and bisphenol A with diphenyl carbonate, which polymerization products must have two terminal hydroxyl groups.

The polyester elastomer is usually selected from copolymers of polylauryllactam, polybutylene glycol which is produced from 1,4-butanediol, and at least one dicarboxylic acid or its functional derivative. The hardness of the polyester elastomer can be controlled by controlling the molecular weight of the polybutylene glycol, which is an elasticity-generating component, or by varying the ratio of the amount of the polylauryllactam to that of the elasticity-generating component.

Another preferable polyester elastomer is selected from block copolymers of polytetramethylene terephthalates with long chain alkylene glycol-terminated tetramethylene terephthalate.

The edge filamentary segments (B2) consist essentially of at least one thermoplastic low elastic polymer (b), which is one capable of forming a filament by a melt-spinning process and preferably has a melting point of 205° C. to 265° C.

The edge filamentary segments (B2) may consist of the same type of low elastic polymer (b). Alternatively, the edge filamentary segments (B2) may consist of different types of low elastic polymers.

The polymer (b) is preferably selected from the group consisting of non-elastic polyamide homopolymers and copolymers and non-elastic polyester homopolymers and copolymers.

The polyamide is preferably selected from nylon 6, nylon 66, nylon 610, nylon 11, nylon 12, and nylon 13.

The polyester is preferably selected from polyethylene terephthalate, polybutadiene terephthalate, polypropylene terephthalate, and copolymers of the above-mentioned polymers with an additional component consisting of 5-sodium sulfoisophthalic acid.

The elastomer (a) and the low-elastic polymer (b) should be selected after careful consideration that the protrudent filamentary segments (B1) and the edge filamentary segments (B2) have a satisfactory compatibility with each other and can be firmly bonded to each other to an extent such that the segments (B1 and B2) are never separated from each other while the composite filaments are processed in melt-spinning, drawing, finishing, weaving and/or knitting procedure.

When the elastomer (a) consists of a polyester elastomer, the low elastic polymer (b) preferably consists of a low-elastic polyester. The low elastic polyester is preferably a 5-sodium sulfoisophthalic acid-copolymerized polyethylene terephthalate which exhibits an improved bonding property. When this 5-sodium sulfoisophthalic acid-containing copolyester is used as a low elastic polymer (b), the elastomer (a) may consist of a polyamide elastomer.

When the low elastic polymer (b) consists of a polyamide, the elastomer (a) preferably consists of a member selected from caprolactone-containing polyurethane elastomers, polycarbonate ester-containing polyurethane elastomers, and polyamide elastomers, for example, polylauryllactam-polyol copolymers.

The elastomer (a) and the polymer (b), particularly the low elastic polyamide, may contain an agent for improving the resistance to light and ultraviolet rays, which may consist of at least one selected from light resistant benzophenone and benzotriazol compounds and inorganic magnesium compounds.

When the axial filamentary constituent (A) and the protrudent filamentary segments (B1) are made of a polyurethane elastomer (a) having an excellent elastic recovery from elongation, the resultant composite filament exhibits a superior stretchability.

Either or both of the axial filamentary constituent (A) and the edge filamentary segments (B2) may be hollow filamentary components.

Where the elastomer (a) consists of a polyamide elastomer, the melt-spinning procedure can be carried out at a high efficiency without undesirable heat decomposition of the elastomer (a), and the resultant composite filament exhibits an improved dyeing property in comparison with a polyurethane elastomer-containing composite filament.

Where the elastomer (a) consists of a polyester elastomer, the protrudent filamentary segments (B1) can be firmly bonded to the edge filamentary segments (B2) consisting of a low elastic polyester, and the resultant composite filaments exhibit an improved compatibility with polyester filament yarns and an enhanced uniform dyeing property and touch, and are easily utilized to produce bonded woven or knitted fabrics.

Where the polymer (b) is a polyamide, the resultant composite filament exhibits an enhanced dyeing property and an excellent abrasion resistance. Also, where nylon 6 is used as the polymer (b), the melt-spinning procedure becomes easy because the nylon 6 has a melting point lower than that of nylon 66 and close to that of the elastomer (a), the production cost of the composite filament is reduced due to the low price of nylon 6, and the resultant composite filament exhibits an improved mechanical strength due to the superior mechanical strength of nylon 6.

From the viewpoint of ease in the melt spinning procedure, nylon 12 is preferable as the polymer (b) because the melting point of nylon 12 is very close to that of the elastomer (a), and nylon 12 has a good mechanical strength.

When the polymer (b) consists of a polyester, for example, polyethylene terephthalate, the resultant composite filament exhibits a satisfactory even dyeing property and touch and a good compatibility with other polyester filament yarns, and can be easily utilized to produce bonded woven or knitted fabrics. However, when a polyester is used as a low elastic polymer (b), the elastomer (b) preferably consists of a polyester elastomer or a polyamide elastomer which have a good compatibility with the low elastic polyester.

Where the polymer (b) consists of polyethylene terephthalate, the resultant composite filament exhibits an improved mechanical property and a satisfactory dry touch.

Where the polymer (b) consists of polybutylene terephthalate, the melt-spinning procedure can be easily carried out at an improved efficiency because the melting point of the polybutylene terephthalate is close to that of the elastomer (a), and the resultant composite filament can be dyed in brilliant colors.

Where the elastomer (a) consists of a polyurethane elastomer and the polymer (b) consists of a polyamide, the resultant composite filaments exhibit a high stretchability due to the high elasticity of the polyurethane elastomer, and an excellent mechanical strength, abrasion resistance and dyeing property due to those of the polyamide, and therefore, are very useful for swimming suits and stockings, which are required to have an excellent stretchability, abrasion resistance, and dyeing property.

Where the elastomer (a) consists of a low elastic polyamide elastomer and the polymer (b) consists of a polyamide, the resultant composite filament exhibits an improved dyeing property, because the dyeing properties of the polyamide elastomer (a) and the low elastic polyamide (b) are excellent and similar to each other.

The composite filament of the present invention has the following advantages.

① The composite filament exhibits an excellent stretchability and elastic recovery force, because these properties are derived from the excellent elasticity of the elastomer (a) but not from three dimensional crimps.

② The change in bulkiness of the composite filament due to stretching, and the recovery thereof, corresponds to only the change in thickness of the composite filament. Accordingly, the composite filament can be converted to a high density fabric which can exhibit an excellent stretchability and a high elastic recovery force irrespective of fabric structure.

③ As mentioned above, the stretch and recovery of the composite filament results only in a change in the thickness thereof and, therefore, the changes in bulkiness and light transmittance of the composite filament fabric due to the stretch and recovery thereof are very small.

④ Since the axial filamentary constituent consisting of an elastomer (a), which is disadvantageous in that it has a high light-deterioration property and a poor dying property, is covered by the edge filamentary to segments consisting of a low elastic polymer (b), which is free from the above-mentioned disadvantageous properties, the composite filament can avoid the above-mentioned disadvantages.

⑤ The edge filamentary segments covering the axial filamentary constituent can avoid the usual disadvantage in that the elastomer (a) has a high frictional resistance to yarn guides. Therefore, the composite filament yarn can be easily processed in a wearing or knitting process without breakage and/or unevenness in tension of the filament yarn.

⑥ Since the outer layer of the composite filament is composed of a plurality of edge filamentary segments, the composite filament, which is a monofilament, acts like a multi-filament yarn.

⑦ Due to the multifilament yarn-like appearance, the composite filament can be used in place of a multifilament yarn without disadvantages, in that when the multifilament yarn is subjected to a wearing or knitting process, individual filaments in the yarn are disjointed from each other and separately broken.

Accordingly, the composite filament of the present invention can be utilized in various fields.

The composite filament of the present invention can be produced by a filament-forming process including at least a melt-spinning step and a drawing step. This process is carried out by means of a specific composite spinneret comprising an axial spinning orifice constituent (A') located in a central portion of the composite spinneret and consisting of at least one spinning hole formed in parallel to the longitudinal axis of the composite spinneret and connected to a supply source of a melt consisting essentially of a synthetic thermoplastic elastomer (a); and a plurality of composite lobe spinning orifice constituents (B') arranged around the axial spinning orifice constituent (A') and comprising a plurality of protrudent spinning orifice segments (B1') connected to the supply source of the melt of the elastomer (a) and a plurality of edge spinning orifice segments (B2') each connected to a supply source of a melt of a thermoplastic low elastic polymer (b) having a smaller heat shrinkage than that of the elastomer (a).

In the melt-spinning step, melts of at least two different polymers are extruded through a specific composite spinneret in such a manner that (i) a portion of a melt consisting essentially of a synthetic thermoplastic elastomer (a) is extruded through an axial spinning orifice constituent (A') located in a central portion of the composite spinneret to provide an axial filamentary stream of the elastomer (a) melt, (ii) the remaining portion of the melt consisting essentially of the synthetic thermoplastic elastomer (a) is extruded through a plurality of protrudent spinning orifice segments (B1') to provide a plurality of protruding filamentary streams of the elastomer (a) melt; and (ii) at least one melt, each consisting essentially of synthetic thermoplastic low elastic polymer (b) having a smaller heat shrinkage than that of the elastomer (a), is extruded through a plurality of edge spinning orifice segments to provide a plurality of edge filamentary streams of the polymer (b) melt.

The above-mentioned axial filamentary stream of the elastomer (a) melt is united with the protrudent filamentary stream of the elastomer (a) melt and the edge filamentary streams of the polymer (b) melt to form a body of a composite filamentary stream. The composite filamentary stream is solidified by cooling to provide an undrawn composite filament.

The resultant undrawn composite filament is drawn to provide an drawn composite filament.

When the drawing operation is completed and the drawn composite filament is released from tension, the elastic recovery from elongation and/or thermal shrinkage of the axial filamentary constituent (A) are larger than those of the edge filamentary segments (B2). Due to the asymmetric structure of the composite lobe filamentary constituents (B), the differences in elastic recovery and/or thermal shrinkage between the axial filamentary constituent (A) and the edge filamentary segments (B2) cause the composite lobe filamentary constituents (B) to be spirally coiled around the axial filamentary constituent (A) in alternately reversed two opposite directions. That is, the spiral structure of the composite lobe filamentary constituents (B) allows the axial filamentary constituent (A) to shrink while being twisted in the same direction as that of the spiral, and to absorb the coiling strains of the composite lobe filamentary constituents (B). When the coiling strain in one direction is completely absorbed by the twisting of the axial filamentary constituent (A), the direction of the spiral coiling is reversed. Therefore, the composite filament has, as a whole, very little torque.

In the composite filament, the axial filamentary constituent (A) consists essentially of an elastomer which has an excellent elastic recovery from elongation and a low torsional rigidity. This physical property of the elastomer (a) is highly effective for generating the spiral coiling structure of the composite filament of the present invention.

Also, because the spiral coiling structure has the alternately reversed two opposite directions, the elastic recovery of the composite filament from the elongation does not generate a high torque thereon. This feature is advantageous for stretchable woven or knitted fabrics having a preferable uniform touch.

Figure 4A:
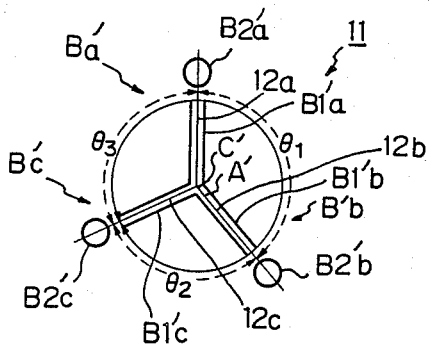
FIG. 4A is a schematic view of a typical embodiment of the composite spinneret usable for producing the composite filament of the present invention.

Referring to FIG. 4A which shows a typical embodiment of a composite spinneret usable for producing the composite filament of the present invention, the composite spinneret 11 comprises an axial spinning orifice constituent A' located in a central portion of the composite spinneret 11, and a plurality of composite lobe spinning orifice constituents B'a, B'b, B'c arranged around the axial spinning orifice constituent A' and comprising a plurality of protrudent spinning orifice segments B1'a, B1'b, B1'c which are connected to the axial spinning orifice constituent A' to form a multilobal opening, and a plurality of edge spinning orifice segments B2'a, B2'b, B2'c which are separated from the protrudent spinning orifice segments B1'a, B1'b, B1'c.

The protrudent spinning orifice segments B1'a, B1'b, B1'c are respectively arranged along radial protrudent lines 12*a*, 12*b* and 12*c* radially drawn from the longitudinal axis c' of the composite spinneret 11.

Also, the edge spinning orifice segments B2'a, B2'b and B2'c are located respectively on extensions of the radial protrudent lines 12*a*, 12*b* and 12*c*. These radial protrudent lines form angles $\theta_1$, $\theta_2$, and $\theta_3$ therebetween. In the spinneret shown in FIG. 4A, the angles $\theta_1$, $\theta_2$ and $\theta_3$ are different from each other. That is, the composite lobe spinning orifice constituents Ba, Bb, and Bb are asymmetric in angular location thereof around the axis c' of the spinneret 11.

The composite spinneret indicated in FIG. 4A is effective for controlling the thickness of the protrudent filamentary constituents B1 of the composite filament to a desired level.

Figure 4B:
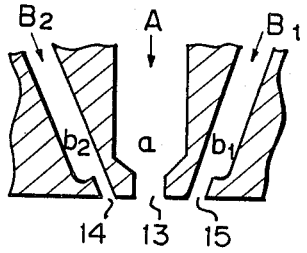
FIG. 4B is a schematic vertical cross-sectional view of an embodiment of the composite spinneret; and, FIGS. 4C to 4E, respectively, are schematic views of other embodiments of the composite spinneret.

Referring to FIG. 4B, a elastomer (a) is extruded through a multilobal spinning opening 13 which includes the axial spinning orifice constituent (A') connected to the protrudent spinning orifice constituents (B1'). A plurality of low elastic polymer $b_1$ and $b_2$ are separately extruded through edge spinning orifice segments 14 and 15 in directions intersecting the extruding direction of the elastomer (a) through the spinning opening 13. Accordingly, the extruded multilobal stream of the elastomer (a) melt can be bonded with the extruded plural edge filamentary stream of the polymer (b1, b2) melts directly below the composite spinneret.

Where the elastomer (a) melt and the polymer (b) melt have a remarkably different viscosity and/or extruding rate, the uniting of the extruded melt streams directly below the spinneret is effective for improving the spinning stability and for preventing an undesirable kneeling phenomenon.

Figure 4C:
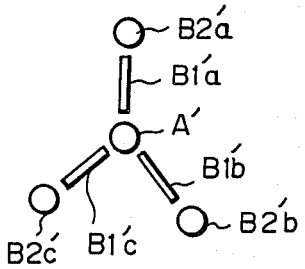

Referring to FIG. 4C, the protrudent spinning orifice segments B1'a to B1'c are separated from the axial spinning orifice constituent A' and from the edge spinning orifice constituents B2'a to B2'c. This type of spinneret is effective for forming an axial filamentary constituent (A) having an enlarged cross-sectional area and protrudent filamentary constituents (B1) having a small cross-sectional thickness (width).

The spinneret shown in FIG. 4C is, however, disadvantageous in that the extruding rates of the elastomer (a) melt through the axial spinning orifice constituent (A') and the protrudent spinning orifice constituent (B1') are different, and this difference causes an unstable uniting of the axial filamentary stream of the elastomer (a) melt with the protrudent filamentary streams of the elastomer (a) melt.

Figure 4D:
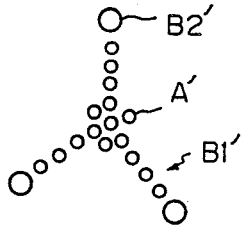

This disadvantage can be removed by using a composite spinneret as shown in FIG. 4D.

Referring to FIG. 4D, the axial spinning orifice constituent A' consists of a plurality of spinning holes, and each of the protrudent spinning orifice segments B1' also consists of a plurality of spinning holes. Furthermore, each of the edge spinning orifice segments B2' many consist of a plurality of spinning holes, if necessary.

The spinneret as shown in FIG. 4D is effective for providing an axial filamentary constituent (A) having a relatively large cross-sectional area and protrudent filamentary segments (B1) having a relatively small cross-sectional thickness. Also, this type of spinneret is advantageous in that the spinning holes in the axial spinning orifice constituent A' and the protrudent spinning orifice segments B1' have substantially the same cross-sectional area as each other, the extruding rates of the elastomer (a) melt through the spinning holes are substantially equal to each other, and this equality stabilizes the extruding operation even if the cross-sectional thickness of the protrudent filamentary segments (B1) is small.

Figure 4E:
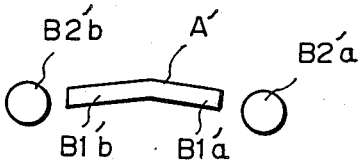

Referring to FIG. 4E, an axial spinning orifice constituent A' is connected to two protrudent spinning orifice segments B1'a and B1'b to provide a hooked slit shaped spinning opening for extruding an elastomer (a). Two edge spinning orifice segments B2'a and B2'b are respectively located close to the outermost ends of the protrudent spinning orifice segments B1'a and B1'b.

In the procedure for bonding the axial filamentary elastomer (a) melt stream with the protrudent filamentary elastomer (a) melt streams and the edge filamentary polymer (b) melt streams into a body of composite filamentary melt stream, preferably the edge filamentary polymer (b) melt streams are substantially continuously bonded to the corresponding protrudent filamentary elastomer (a) melt streams along the longitudinal axis of the composite filamentary melt stream. In a bonding method for this purpose, the elastomer (a) melt streams and the polymer (b) melt streams are united within the spinneret, and the resultant united composite filamentary melt stream is then extruded from the spinneret.

In another method, the filamentary melt streams are separately extruded from the spinneret and are then united into a composite filamentary melt stream below the spinneret. In the latter bonding method, the distances between the outermost ends of the protrudent spinning orifice segments (B1') and the closed ends of the edge spinning orifice segments (B2') to the above-mentioned outermost ends, should be adjusted to a proper value, usually, 0.03 mm to 0.1 mm, in consideration of the viscosities of the melts to be extruded and, extruding rates, temperatures and linear speeds of the melts.

For the composite spinneret usable for the present invention, the following should be noted.

(a) In the composite spinneret, where the protrudent spinning orifice segments or holes are arranged at angularly asymmetrical locations around the longitudinal axis of the spinneret, it is easy to provide a composite filament having a geometrically asymmetric cross-sectional profile.

(b) Where the plural protrudent spinning orifice segments have a different length or number of holes, it is easy to produce a composite filament provided with plural composite lobe filamentary constituents (B) which have a different cross-sectional length.

(c) Where the plural protrudent spinning orifice segments have a different width or size of holes, it is easy to produce a composite filament having a cross-sectional profile which is geometrically asymmetric with respect to the cross-sectional width (thickness) of the protrudent filamentary segments.

(d) The elastomer (a) melt can be extruded through the protrudent spinning orifice segments at different extruding rates by changing the opening sizes and the lengths of the melts paths of the protrudent spinning orifice segments, to provide a composite filament having a geometrical asymmetric cross-sectional profile.

(e) Where the edge spinning orifice segments have irregular non-round spinning openings, the resultant composite filament can be easily provided with edge filamentary segments having a non-round cross-sectional configuration.

(f) Where the edge spinning orifice segments have different configurations and sizes, the resultant composite filament has edge filamentary segments having different cross-sectional configurations and sizes.

(g) Where two or more different polymers (b) are separately extruded through the edge spinning orifice segments, the resultant edge filamentary segments have different properties. For example, the polymers (b) have a different dyeing property, the dyed edge filamentary segments spirally coiling around and covering the axial filamentary constituent exhibit a plural color effect at very small pitches along the longitudinal and transverse directions, and the dyed composite filament exhibits a unique and mild color tone.

(h) Even if the composite spinneret is geometrically symmetrical about the longitudinal axis thereof, the resultant composite fiber can be provided with the spiral coil structure of the composite lobe filamentary constituents by making the edge filamentary segments from different polymers (b).

The melt-spun composite filamentary stream is cooled in an inert fluid atmosphere to provide a solidified, undrawn composite filament.

The solidified composite filament is oiled and drawn at a desired draw ratio, to provide a drawn composite filament having an enhanced stretchability and mechanical strength.

Optionally, a head treatment is applied to the composite filament to enhance the stretchability of the composite filament.

The purpose of the heat treatment is to partially cross-link the elastomer (a) molecules and to enhance the elastic recovery of the elastomer (a). Accordingly, the heat treatment is preferably applied to the composite filament when not under tension, i.e., the composite filament is in an elastically recovered condition, at a stage between the solidifying step and the drawing step or after the drawing step.

When the heat treatment is applied to the composite filament when under tension, the intensity of the heat treatment should be limited to an extent such that a cross-linkage is not generated between the elastomer (a) molecules. That is, a heat treatment of the composite filament when under tension is very disadvantageous and should be avoided.

Accordingly, when the drawn composite filament is directly wound up, the composite filament should be subjected, as soon as possible, to the next procedures in which the composite filament is heat-relaxed, for example, the knitting and dyeing procedures. If the drawn, composite filament is stored in a wound up condition for a long period, the elastomer (a) in the composite filament is naturally aged under the stretched condition and is cross-linked. This cross-linkage causes a large reduction in stretchability of the composite filament.

Accordingly, the heat treatment is preferably carried out as follows.

(a) The heat treatment is applied to the undrawn filament, and the heat-treated filament is drawn and then wound up.

This method is advantageous in that the undrawn composite filament can be in the form of a package, and the heat treatment temperature and time necessary for the cross-linkage of the elastomer (a) molecules can be easily decided. The heat treatment temperature is variable depending on the heat treatment time. For example, the heat treatment for the undrawn composite filament is carried out at a temperature of 100° C. for 60 minutes or at about 60° C. for about one to two days. Nevertheless, the heat treatment temperature should not exceed 140° C., because a heat treatment temperature higher than 140° C. causes an undesirable deterioration of the elastomer (a).

(b) The heat treatment is applied to a drawn composite filament not under tension.

In this method, although the elastomer molecules in the drawn composite filament are not yet cross-linked, the composite filament is relaxed and heat treated so that the elastomer molecules are cross-linked while not under tension. This is also effective for preventing the phenomenon whereby, after the composite filament is woven or knitted, the thickness of the composite filament increases due to shrinkage of the low elastic polymer (b).

Accordingly, preferably the drawn composite filament is directly relaxed and heat treated without winding up. The heat relax-treatment can be effected by any conventional method, for example, bringing the composite filament into contact with a fixed heating plate, forwarding the composite filament through a hot gas atmosphere, forwarding the composite filament through a hot liquid, stuffing the composite filament with a hot fluid, or forwarding the composite filament on a heat-relaxing tapered roller. The hot fluid stuffing method is advantageous in that the heat treatment can be applied over a long period and at a high speed. Also, the heat-relaxing tapered roller method is advantageous in that the forwarding path of the composite filament can be shifted depending on the shrinking rate of the composite filament.

The heat relax-treatment temperature is decided in consideration of the way of treatment, the treatment rate and the treatment time, and usually is in the range of 70° C. or more but below the melting points of the elastomer (a) and polymer (b).

The drawn composite filament may be preheated before the heat relax-treatment. This preheating is effective for smoothing the heat relax and shrinkage of the composite filament during the heat relax treatment.

(c) The heat treatment is applied to the undrawn composite filament and an additional heat treatment is applied to the drawn composite filament not under tension.

This is most effective for enhancing the stretchability of the composite filament.

In the production of the present invention, the melt-spinning step may be directly followed by the drawing step without winding up the undrawn filament. This direct melt-spinning, drawing method is advantageous in that the undrawn filament is not wound and, therefore, is quite free from undesirable adhesion between the filaments due to the elastomer (a), and thus there is no difficulty in unwinding the resultant drawn filament during the unwinding operation of the filament from a filament package.

The melt-spinning step, the drawing step, and the heat relax treatment step can be continuously carried out. This method is advantageous in that the factory space, the number of workers, and the cost necessary for the production of the composite filament can be reduced.

After the heat relax-treatment is completed, the resultant composite filament can be wound up under a small tension, which does not affect the stretchability of the composite filament or the ease of handling of the resultant filament package.

The composite filament of the present invention is useful for producing a stretchable woven or knitted fabric.

The stretchable composite filament-containing woven or knitted fabric has the following advantages.

① Since a large elasticity of the elastomer (a) is utilized, the composite filament fabric exhibits an excellent stretchability.

② When a composite filament is stretched or elastically recovered, the composite lobe filamentary constituents are deformed from a spiral coil form to a straight form or from a straight form to a spiral coil form. When the composite filament is contained in a high density woven or knitted fabric, the above-mentioned mode of deformation of the composite lobe filamentary constituents is very effective for reducing frictional resistance to movement of the composite filaments, which intersect each other when the fabric is stretched or recovered.

③ The stretch and elastic recovery of the composite filament causes very little change in the bulkiness of the composite lobe filamentary constituents. Therefore, the change in bulkiness of the composite filament fabric due to the stretch and elastic recovery thereof is very small.

④ Also, the change in light transmittance of the composite filament fabric due to the stretch and elastic recovery thereof is very small even if the fabric is thin.

⑤ The edge filamentary segments and the protrudent filamentary segments are firmly bonded to each other, and thus are rarely separated from each other or broken even when the composite filament fabric is caught or rubbed.

⑥ The axial filamentary constituent and the protrudent filamentary segments consisting of an elastomer (a), which has a relatively low resistance to light deterioration, are protected from light deterioration by the edge filamentary segments consisting of the low elastic polymer (b) which has a relatively high light resistance. Therefore, the composite filament fabric exhibits a satisfactory light resistance and durability.

⑦ The outermost layer of the composite filament is composed of the edge filamentary segments consisting of the polymer (b), which has a better dyeing property than that of the elastomer (a). Therefore, the composite filament fabric can be evenly dyed.

⑧ Also, since the outermost layer consisting of the spirally coiled edge filamentary segments has a good touch, the composite filament fabric has a good touch.

The woven or knitting fabric consisting of 100% of the composite filament of the present invention can exhibit all the advantages mentioned above. Also, if the composite filament of the present invention is present in an amount of a few %, the resultant composite filament fabric can exhibit at least one of the above-mentioned advantages.

In stockings having a low yarn density, the composite filament of the present invention is preferably contained at a content of 5% by weight or more, more preferably 10% by weight or more.

In swimming suits and slacks having a high yarn density, the composite filament is preferably contained at a content of at least 15% by weight.

A woven or knitted fabric containing the composite filament of the present invention, in which the edge filamentary segments have a non-round cross-sectional configuration, exhibits an excellent gloss.

A woven or knitted fabric containing the composite filament of the present invention in which the edge filamentary segments consist essentially of, independently from each other, polymers (b) having different dyeing properties and gloss, exhibit a unique iridescent color and gloss.

The woven or knitted fabric containing the composite filament of the present invention having a small torque, has a uniform surface condition, is free from undesirable curling of the edge portions thereof, and is useful as a thin or low yarn density fabric.

Although the composite filament of the present invention is a monofilament, the woven or knitted fabric comprising the composite filament appears to be a multifilament fabric.

In the production of a woven or knitted fabric, the composite filament of the present invention has the following advantages.

① Since the outermost layer of the composite filament consists of the edge filamentary segments which consist essentially of the polymer (b) having a relatively high melting point and is in the form of spiral coils, the composite fiber filament exhibits a low friction and can be easily woven or knitted with a reduced unevenness and yarn defect rate.

② Also, defects in the woven or knitted fabric due separation of the edge filamentary segments from the protrudent filamentary segments rarely occur.

③ Because the composite filament has a small or no torque, snarls are not formed during the weaving or knitting process.

④ Also, due to the small or no torque, an S and Z twisting equipment necessary for false-twisted bulky yarn can be omitted.

⑤ A stretch knitting equipment necessary in the production of a composite yarn composed of an elastomer filament and non-elastic filament can be omitted in the production of the composite filament fabric.

The present invention will be further explained by way of specific examples which, however, are representative and do not restrict the scope of the present invention in any way.

EXAMPLES 1 to 6

In Example 1, a melt of a thermoplastic elastomer (a) consisting of a polyurethane elastomer (available under the trademark Elastoran E 595 from Nippon Elastoran Co.) prepared at a temperature of 220° C. and another melt of a thermoplastic low elastic polymer (b) consisting of nylon 6 having an intrinsic viscosity [$\eta$] of 1.1 prepared at a temperature of 255° C. were extruded through a composite spinneret having a single composite spinning orifice as shown in FIG. 4A at a temperature of 235° C. The ratio in extruding rate of the elastomer (a) melt to the polymer (b) melt was controlled to 5/5 by means of gear pumps. In the composite spinnerets, the angles $\theta_1$, $\theta_2$ and $\theta_3$ formed between the protrudent spinning orifice segments B1'a, B1'b and B1'c were adjusted to the values shown in Table 1.

The extruding rates of the elastomer (a) melt and the polymer (b) melt were controlled so that the resultant drawn composite filament had a denier of 15.

The extruded filamentary streams of the elastomer (a) melt and the polymer (b) melt were united, the resultant composite filamentary stream was cooled with cooling air, and the resultant undrawn composite filament was oiled with 2.0% by weight of a silicone oil and then taken up and wound up into a package at a speed of 500 m/min.

The undrawn composite filament package was heat treated in a hot air atmosphere at a temperature of 100° C. for one hour.

The heat treated composite filament was drawn at a drawing speed of 400 m/min at a draw ratio of 3.2 (peripheral speed of feed roller: 125 m/min, peripheral speed of drawing roller: 400 m/min), and successively, the drawn composite filament was heat relax-treated at a relax ratio of 40% at a temperature of 150° C. by means of a non-touch heater (speed of delivery roller: 240 m/min) and was wound up. The composite filament was then converted to a hank, and the hank was treated in boiling water under a load of 1 mg per denier of the drawn composite filament for 20 minutes, and was naturally dried in a room at a temperature of 20° C. and an RH of 65%, while not under tension, for 24 hours.

The stretchability (%) of the dried composite filament was determined by the following test.

The dried composite filament was loaded at a load of 200 mg+1 mg per denier of the drawn composite filament for 2 minutes and the length ($l_1$) of the composite filament under the above-mentioned load was measured. Then, the load of 200 mg/d was immediately removed and the composite filament was maintained under a load of 1 mg/d for 2 minutes. The length (l) of the composite filament was measured.

The stretchability of the composite filament was calculated in accordance with the following equation:

$$\text{Stretchability (\%)} = \frac{l_1 - l_2}{l_2} \times 100$$

In each of Examples 2 to 6, the same procedures as those described in Example 1 were carried out with the following exception.

In Example 2, a heat treatment was not applied to the undrawn composite filament package.

In Example 3, a heat relax-treatment was not applied to the drawn composite filament.

In Example 4, a heat treatment was not applied to the undrawn composite filament and a heat relax-treatment was not applied to the drawn composite filament.

In Example 5, the values of the angles $\theta_1$, $\theta_2$ and $\theta_3$ were changed as shown in Table 1.

In Example 6, the angles $\theta_1$, $\theta_2$ and $\theta_3$ were the same as those in Example 5 and a heat treatment was not applied to the undrawn composite filament.

In Comparative Example 1, the same procedures as those described in Example 1 were carried out except that the angles $\theta_1$, $\theta_2$ and $\theta_3$ were the same as each other, and a boiling water treatment was not applied to the drawn, heat relax-treated composite filament.

The results are shown in Table 1.

TABLE 1

| | Angles between protudent spinning orifice segments $\theta_1$-$\theta_2$-$\theta_3$ ° (degree) | Spiral coil Heat treatment of undrawn filament | Spiral coil Heat relax-treatment of drawn filament | Cross-sectional profile of composite filament | structure before boiling water treatment | structure after boiling water treatment | Stretchability (%) |
|---|---|---|---|---|---|---|---|
| Example | | | | | | | |
| 1 | 130-120-110 | yes | yes | asymmetric | yes | yes | 152 |
| 2 | 130-120-110 | yes | no | " | yes | yes | 138 |
| 3 | 130-120-110 | no | yes | " | yes | yes | 130 |
| 4 | 130-120-110 | no | no | " | no | yes | 116 |
| 5 | 130-130-110 | yes | yes | " | yes | yes | 144 |
| 6 | 130-130-100 | no | yes | " | yes | yes | 137 |
| Comparative Example | 120-120-120 | yes | yes | symmetric | no | no | 32 |

Table 1 shows that the composite filaments of Examples 1 to 6 had an excellent stretchability. When the composite filaments of Examples 1 to 6 were not under tension, the composite lobe filamentary constituents of each composite filaments were in a spiral coil structure around an axial filamentary constituent as indicated in FIG. 3A. The spiral coil structure was alternately reversed in two different directions around the axial filamentary constituent and, therefore, each composite filament had substantially no torque.

When stretched, the appearances of the composite filaments were as shown in FIG. 3B.

The comparative composite filament of Comparative Example 1 exhibited a poor stretchability and rarely had the spiral coil structure in small portions of the filament.

EXAMPLE 7

The wound composite filaments of Examples 1 to 4 were stored in the wound state in air atmosphere at a temperature of 40° C. for 3 months. Thereafter, the stretchabilities of the stored filaments were measured. The results were shown in Table 2.

TABLE 2

| Type of composite filament | Stretchability of stored composite filament (%) |
|---|---|
| As mentioned in Example 1 | 145 |
| As mentioned in Example 2 | 119 |
| As mentioned in Example 3 | 110 |
| As mentioned in Example 4 | 82 |

Table 2 shows that the heat treatment for the undrawn composite filament and the heat relax-treatment for the drawn composite filament are effective for enhancing the durability of the stretchability of the composite filament.

EXAMPLE 8

A melt of an elastomer (u) consisting of a nylon 12 elastomer (available under the trademark X-3978 from Daicel Industrial Co.) prepared at a temperature of 255° C. and another melt of a polymer (b) consisting of nylon 6 were extruded respectively at an extruding rate of 3.5 g/min at a temperature of 250° C. through a composite spinneret having 5 composite spinning orifices as shown in FIG. 4A. The extruding rate ratio of the elastomer (a) melt to the polymer (b) melt was 5/5. The resultant composite filament which was obtained by an air cooling procedure, was oiled with 5% by weight of a spinning oil emulsion while taken up at a speed of 50 ml/min. The oiled composite filament was drawn at room temperature at a draw ratio of 3.4, and the drawn composite filament was successively heat relax-treated by means of fluid stuffing equipment. The heat relax-treated composite filament was then taken up.

In the fluid stuffing procedure, the stuffing fluid was air and the stuffing operation was carried out at a temperature of 130° C. under an air-jetting pressure of 1.0 kg/cm$^2$ at a relax ratio of 35%.

The resultant composite filament had three composite lobe filamentary constituents spirally coiled in alternately reversed two opposite directions around an axial filamentary constituent.

The composite filament exhibited a good stretchability of 118%.

EXAMPLE 9

The same procedures as described in Example 8 were carried out except that the nylon 12 elastomer (a) was melted at a temperature of 240° C.; the polymer (b) consisted of a 25% 5-sodium sulfoisophthalic acid-copolymerized polyethylene terephthalate having an intrinsic viscosity [$\eta$] of 0.56 and was melted at a temperature of 285° C.; the elastomer (a) melt and the polymer (b) melt were extruded at a temperature of 285° C.; and the undrawn composite filament was oiled with 0.42% of a spinning oil emulsion and wound up at a speed of 1000 m/min.

These undrawn filament-forming melt-spinning procedures were continuously carried out for 12 hours without breakage of the filament.

The undrawn filaments were drawn at a draw ratio of 3.2 at a drawing speed of 500 m/min, and successively heat relax-treated at a relax ratio of 35% at a temperature of 150° C. by means of a non-touch heater.

The resultant composite filament had a spiral coil structure as shown in FIG. 3A and exhibited substantially no torque and a good stretchability of 120%.

EXAMPLE 10

The same procedures as those described in Example 1 were carried out with the following exception.

The polyurethane elastomer (a) was melted at a temperature of 220° C. The polymer (b) consisted of nylon 12 and was melted at a temperature of 230° C. The elastomer (a) melt and the polymer (a) melt were melt-spun at a temperature of 230° C. at extruding rates of the elastomer (a) and the polymer (a) of 2.0 g/min and 1.3 g/min, respectively, and an extruding rate ratio of the elastomer (a) polymer (b) of 6/4. The undrawn composite filament, which was cooled with cooling air, was oiled with 2% of a silicone oil and wound up at a speed of 600 m/min.

The undrawn filament, which was preheated by a drawing roller heated at a temperature of 100° C., was drawn at a draw ratio of 3.0 at a drawing speed of 1000 m/min. The drawn filament was successively heat relax-treated by the same heat fluid stuffing method as that mentioned in Example 8, at an air temperature of 120° C. under an air jet pressure of 1.0 kg/cm.

The resultant composite filament had a satisfactory spiral coil structure and exhibited a very high stretchability of 152%.

EXAMPLE 11

The same procedures as those described in Example 10 were carried out with the following exception.

In the composite spinneret used, which was the similar to that shown in FIG. 4A, the angles $\theta_1$, $\theta_2$ and $\theta_3$ between the protrudent spinning orifice segments B1'a, B1'b and B1'c were respectively 130°, 110° and 120°, the edge spinning orifice segment B2'a had a round configuration and the edge spinning orifice segments B2'b and B2'c had a regular triangle configuration. The extruding rates of the elastomer (a) and the polymer (b) were both 1.6 g/min.

The undrawn composite filament, which was cooled with cooling air, was oiled with 2.0% of a silicone oil and wound up at a speed of 600 m/min.

The undrawn composite filament was drawn and heat relax-treated in the same manner as that described in Example 10.

The resultant composite filament had a cross-sectional profile as shown in FIG. 2H and a satisfactory spiral coil structure, and exhibited a high stretchability of 140%.

Examples 12 to 14 and Comparative Examples 2 to 5

In Examples 12, 13 and 14, and Comparative Examples 2, the composite filaments described respectively in Examples 1, 4 and 5 and Comparative Example 1 were knitted into panty-stockings at a speed of 600 rpm by a KT-400 type stocking-knitting machine (made by Nagata Seiki K.K.). The stockings were dyed at a temperature of 80° C. and were finished by the ordinary method.

In Examples 12, 13, and 14, no torque was generated during the knitting procedure and the resultant knitting had no twist and could be easily handled.

The resultant panty-stocking wer subject to an organoleptic wearing test in which 20 women different in size each wore two panty-stockings of each of the Examples and Comparative Examples.

In Comparative Examples 3, 4 and 5, the same organoleptic wearing test as mentioned above was applied to commercial stockings on the market consisting of false-twisted textured yarns (Comparative Example 3), crimp-generating composite filament yarns (Comparative Example 4) and nylon filament covered polyurethane elastomer filament yarns (Comparative Example 5).

The results of the test are shown in Table 3. In the table, the number shows the testers who were satisfied with each of the indicated features of the panty stockings.

TABLE 3

| Example No. | | Type of stretchable filament | Transparent appearance Non-worn | Transparent appearance Worn | Fit and support | Touch |
|---|---|---|---|---|---|---|
| Example | 12 | prepared in Example 1 | 20 | 20 | 20 | 20 |
| | 13 | prepared in Example 4 | 20 | 20 | 20 | 20 |
| | 14 | prepared in Example 5 | 20 | 20 | 18 | 18 |
| Comparative Example | 2 | prepared in Comparative Example 1 | 20 | 20 | 0 | 0 |
| | 3 | False-twisted filament | 0 | 10 | 3 | 8 |
| | 4 | Crimping composite filament | 5 | 16 | 12 | 18 |
| | 5 | Covered elastomer filament | 16 | 16 | 10 | 10 |

Table 3 clearly shows that the knitting made from the composite filaments of the present invention were considered very satisfactory in transparent appearance, fit, and touch by almost all of the testers, who were different in size.

EXAMPLE 15 AND COMPARATIVE EXAMPLE 6

In Example 15, a panty portion of a panty-stocking was produced by union knitting the same composite filament as that described in Example 1 and false-twisted nylon 6 textured filament yarn having a yarn count of 35 denier/10 filaments by the same knitting machine as that described in Example 12 in a mixing ratio of 5/5.The knitting was dyed and finished by the ordinary method.

It was found that the resultant union knitting had a very satisfactory knitting stitch appearance and stretchability.

In Comparative Example 6, the same procedures as those disclosed in Example 15 were carried out except that the union knitting was produced from yarns consisting of a polyurethane elastomer filament covered with a single layer of a false-twisted nylon 6 filament and false-twisted nylon 6 filament yarns.

The resultant comparative union knitting had a satisfactory stretchability but a poor knitting stitch appearance.

EXAMPLE 16 AND COMPARATIVE EXAMPLE 7

In Example 6, a woven fabric was produced from the same composite filaments as that described in Example 8 and false-twisted nylon 6 filament yarns having a yarn count of 50 denier/10 filaments in a mixing ratio of the composite filaments to the nylon 6 yarns of 1/9.

The fabric was relaxed and scoured at a temperature of 80° C., pre-heat set at a temperature of 120° C., dyed at a temperature of 100° C., and heat-finish set at a temperature of 130° C. for 30 seconds by an ordinary process.

The resultant fabric exhibited an elongation percentage X of 26% and a recovery percentage Z of 96%.

The elongation percentage X and recovery percentage Z were determined as follows.

Two end portions of a fabric specimen having a length of 15 cm and a width of 5 cm were gripped with a pair of clamps of a tensile tester (Trademark: Instron III, Instron Co.) so that the distance between the clamps on the specimen was 10 cm, and the specimen was first stretched at a stretching rate of 10 cm/min while a tensile stress created on the specimen was recorded on a chart in correspondence to elongation percentage of the specimen based on the original length of the specimen.

When the tensile stress reached 58 g, the first stretching operation was stopped and the clamps then returned to the original positions thereof at a returning rate of 100 cm/min and kept at the original positions for one minute. Then, the specimen was stretched again at a rate of 100 cm/min. When the created tensile stress on the specimen reached 50 g, the second stretching operation was stopped.

An elongation percentage corresponding to the tensile stress of 58 g at the first stop refers to a first elongation percentage X.

Also, an elongation percentage corresponding to the tensile stress of 50 g at the second stop refers to a second elongation percentage Y.

The recovery percentage (Z) is calculated from the equation:

$$Z = \frac{X - Y}{X} \times 100$$

In Comparative Example 7, the same procedures as those described in Example 16 were carried out except that the woven fabric was produced from the false-twisted nylon 6 filament yarns alone.

The comparative fabric exhibited a poor elongation percentage X of 12% and an unsatisfactory recovery percentage Z of 85%.

I claim:

1. A stretchable synthetic polymer composite filament, comprising:

(A) an axial filamentary constituent extending along the longitudinal axis of the filament;

(B) a plurality of composite lobe filamentary constituents consisting of protrudent filamentary segments (B1) outwardly protruding from the axial filamentary constituent (A) in different directions from each other and extending along the axial filamentary constituent (A) and edge filamentary segments (B2) attached to outside ends of the protrudent filamentary segments (B1) and extending along the protrudent filamentary segments (B1), the axial filamentary constituent (A) and the protrudent filamentary segments (B1) consisting essentially of a synthetic thermoplastic elastomer (a) having a melting point of from 180° C. to 240° C., and the edge filamentary segments (B2) consisting essentially of at least one synthetic thermoplastic low elastic polymer (b) having a melting point of from 205° C. to 265° C., in which filament, when not under tension, the composite lobe filamentary constituents (B) are asymmetric with respect to at least one feature of the location thereof and cross-sectional configurations and sizes of the protrudent and edge filamentary segments (B1 and B2), about the longitudinal axis of the filament, and are spirally coiled around the axial filamentary constituent (A) in alternately reversed two opposite directions.

2. The composite filament as claimed in claim 1, wherein the edge filamentary segments (B2) are substantially completely fixed to the corresponding protrudent filamentary segments (B1).

3. The composite filament as claimed in claim 1, wherein the spirally coiled lobe filamentary constituents (B) are parallel to each other when not under tension.

4. The composite filament as claimed in claim 1, wherein the lobe filamentary constituents (B) are in the number of 2 to 6.

5. The composite filament as claimed in claim 1, wherein the lobe filamentary constituents (B) are protruded at angles formed between two adjacent constituents different from each other.

6. The composite filament as claimed in claim 1, wherein the protrudent filamentary segments (B1) are asymmetric in at least one of cross-sectional configuration and size and location thereof about the longitudinal axis of the fiber.

7. The composite filament as claimed in claim 1, wherein the protrudent filamentary segments (B1) have different lengths thereof from each other.

8. The composite filament as claimed in claim 1, wherein the protrudent filamentary segments (B1) have different areas thereof from each other.

9. The composite filament as claimed in claim 1, wherein the edge filamentary segments (B2) have different areas thereof from each other.

10. The composite filament as claimed in claim 1, wherein the edge filamentary segments (B2) have a substantially round cross-sectional profile thereof.

11. The composite filament as claimed in claim 1, wherein the edge filamentary segments (B2) have a non-round cross-sectional profile thereof.

12. The composite filament as claimed in claim 1, wherein the edge filamentary segments (B2) are different in cross-sectional configuration and size thereof from each other.

13. The composite filament as claimed in claim 1, wherein the edge filamentary segments (B2) consist essentially of polymers different from each other.

14. The composite filament as claimed in claim 1, wherein the synthetic thermoplastic elastomer (a) is selected from the group consisting of polyurethane, polyamide and polyester elastomers.

15. The composite filament as claimed in claim 1, wherein the synthetic thermoplastic low elastic polymer (b) is selected from the group consisting of non-elastic polyamide homopolymers and copolymers and non-elastic polyester homopolymers and copolymers.

16. The composite filament as claimed in claim 1, wherein the elastomer (a) is a polyurethane elastomer and the polymer (b) is a non-elastic polyamide.

17. The composite filament as claimed in claim 1, wherein the elastomer (a) is a polyamide elastomer and the polymer (b) is a non-elastic polyamide.

18. The composite filament as claimed in claim 1, wherein the elastomer (a) is a polyamide elastomer and the polymer (b) is a low elastic polyester.

19. The composite filament as claimed in claim 1, wherein the elastomer (a) is a polyester elastomer and the polymer (b) is a low elastic polyester.

* * * * *

UNITED STATES PATENT AND TRADEMARK OFFICE

CERTIFICATE OF CORRECTION

PATENT NO. : 4,861,660

DATED : August 29, 1989

INVENTOR(S) : Seiji Ishii

It is certified that error appears in the above-identified patent and that said Letters Patent is hereby corrected as shown below:

Column 1, line 42, change "requirements" to --required--;

Column 3, line 15, delete "Bb" second occurrence" and insert --Bc--;

Column 5, line 26, change "transversel" to insert --transverse--;

Column 6, line 16, change "constituent" to --constituents--;

Column 6, line 20, change "lengths" to --length--;

Column 10, lines 29-30, "filamentary to segments" to --filamentary segments--;

Column 12, line 44, change "uniting" to --bonding--;

Column 12, line 61, change "uniting" to --bonding--;

Column 13, line 3, change "many" to --may--;

Column 17, line 38, after "due" insert --to--;

Column 18, line 8, change "united" to --bonded--

Column 19, Table 1, change "Sprial Coil Heat" both occurrences to --Heat-- and change "structure" both occurrences to --Spiral Coil Structure--;

Column 19, Table 1 (exp. 5) change "-110" to -- -100--;

Column 19, line 39, delete "were" and insert --are--;

UNITED STATES PATENT AND TRADEMARK OFFICE

CERTIFICATE OF CORRECTION

PATENT NO. : 4,861,660

DATED : August 29, 1989

INVENTOR(S) : Seiji Ishii

It is certified that error appears in the above-identified patent and that said Letters Patent is hereby corrected as shown below:

Column 21, lines 33 and 34 change "was the similar" to --was similar--;

Column 21, line 65, delete "wer" and insert --were--;

Signed and Sealed this

Thirtieth Day of July, 1991

*Attest:*

HARRY F. MANBECK, JR.

*Attesting Officer*

*Commissioner of Patents and Trademarks*